US011472011B1

(12) United States Patent
Kent

(10) Patent No.: US 11,472,011 B1
(45) Date of Patent: Oct. 18, 2022

(54) VEHICLE SUSPENSION SPRING SPREADER

(71) Applicant: Douglas Kent, McPherson, KS (US)

(72) Inventor: Douglas Kent, McPherson, KS (US)

( * ) Notice: Subject to any disclaimer, the term of this patent is extended or adjusted under 35 U.S.C. 154(b) by 94 days.

(21) Appl. No.: 17/003,737

(22) Filed: Aug. 26, 2020

Related U.S. Application Data

(60) Provisional application No. 62/892,276, filed on Aug. 27, 2019.

(51) Int. Cl.
*B25B 27/30* (2006.01)
*B25B 27/00* (2006.01)

(52) U.S. Cl.
CPC ..... *B25B 27/306* (2013.01); *B25B 27/0035* (2013.01)

(58) Field of Classification Search
CPC ..... B25B 27/30; B25B 27/306; B25B 27/00; B25B 27/0035; Y10T 29/53613; Y10T 29/53622; Y10T 29/5363; Y10T 29/53857; Y10T 29/5387
USPC ..... 29/227
See application file for complete search history.

(56) References Cited

U.S. PATENT DOCUMENTS 1,191,240 A 7/1916 Simmons
1,331,602 A 2/1920 Webb
1,348,658 A 8/1920 Nelson
1,350,803 A * 8/1920 Hinckley ..... B25B 27/26 29/218
1,361,219 A 12/1920 Bartenstein
1,456,796 A * 5/1923 Gross ..... B25B 27/0064 29/261
1,467,567 A * 9/1923 Cary ..... B25B 27/26 29/218
1,473,075 A * 11/1923 Bates ..... B25B 27/062 29/261
1,586,360 A 5/1926 Funk et al.
1,605,317 A * 11/1926 Yawman ..... B25B 27/26 29/218
1,614,301 A * 1/1927 Hobbs ..... B25B 27/26 81/302
1,721,723 A * 7/1929 Weston ..... B25B 27/26 29/218

(Continued)

OTHER PUBLICATIONS

"SPC Performance Spring Comp Clamp Set" SparktecMotorSports.com http://www.sparktecmotorsports.com/spc-40250.html.

(Continued)

*Primary Examiner* — Lee D Wilson
*Assistant Examiner* — Jonathan G Santiago Martinez
(74) *Attorney, Agent, or Firm* — Kenneth H. Jack; Davis & Jack, L.L.C.

(57) ABSTRACT

A tool for spreading a vehicle suspension spring, the tool incorporating a base having upper and lower ends; upper and lower arms, each such arm having a proximal end and a distal end, the upper arm's proximal end being pivotally attached to the base's upper end and the lower arm's proximal end being pivotally attached to the base's lower end, and each arm's distal end being adapted for engaging the spring; a screw mounted rotatably upon the base, the screw extending distally between the upper and lower arms; and a nut threadedly mounted upon the screw, the nut having upper and lower ends adapted for slidably engaging the upper and lower arms, the nut being kinetically spinnable for longitudinally repositioning between the upper and lower arms.

13 Claims, 6 Drawing Sheets

(56) References Cited

U.S. PATENT DOCUMENTS

| | | | | | |
|---|---|---|---|---|---|
| 1,951,953 | A | | 3/1934 | Tollonitsch | |
| 2,076,834 | A | | 4/1937 | Wszolek | |
| 2,109,740 | A | * | 3/1938 | Carlborg | B25B 27/023 29/261 |
| 2,265,629 | A | * | 12/1941 | Christiansen | G01G 23/00 267/175 |
| 2,329,591 | A | | 9/1943 | Christian | |
| 2,721,376 | A | * | 10/1955 | Showman | B25B 27/304 29/262 |
| 2,883,742 | A | | 4/1959 | Prath | |
| 3,051,443 | A | * | 8/1962 | Castoe | B25B 27/304 29/217 |
| 3,341,175 | A | * | 9/1967 | Branick | B25B 27/304 29/217 |
| 3,372,457 | A | * | 3/1968 | Selby | B25B 27/023 29/259 |
| 3,747,895 | A | | 7/1973 | Martin | |
| 3,764,107 | A | * | 10/1973 | Mlynarczyk | B25B 27/304 29/218 |
| 3,912,224 | A | | 10/1975 | Castoe | |
| 3,946,987 | A | * | 3/1976 | Shultz | F16F 1/13 29/227 |
| 4,061,308 | A | * | 12/1977 | Ghent | B25B 27/304 29/227 |
| 4,156,959 | A | * | 6/1979 | Weisenburger | B25B 27/12 29/225 |
| 4,219,918 | A | * | 9/1980 | Klann | B25B 27/304 D8/51 |
| 4,832,321 | A | * | 5/1989 | Aardema | B60G 11/14 267/287 |
| 4,930,751 | A | * | 6/1990 | Hutchins | B25B 27/304 29/227 |
| 4,976,416 | A | * | 12/1990 | Klann | B25B 27/304 267/286 |
| RE34,097 | E | * | 10/1992 | Kloster | B25B 27/304 403/328 |
| 5,172,889 | A | | 12/1992 | Post et al. | |
| 5,367,755 | A | | 11/1994 | Wood | |
| 5,954,314 | A | * | 9/1999 | Weisshaar | B25B 27/304 29/227 |
| 6,029,331 | A | * | 2/2000 | Simmons | B25B 27/0035 29/256 |
| 6,978,982 | B1 | * | 12/2005 | Jin | B25B 27/304 29/238 |
| 8,112,856 | B2 | * | 2/2012 | Huang | B25B 27/304 29/230 |
| 2012/0102704 | A1 | * | 5/2012 | Barrios | B25B 27/023 29/256 |

OTHER PUBLICATIONS

"5280 Brake Shoe Spreader For Volvo Trucks" LaserTools.co.uk http://www.lasertools.co.uk/item.aspx?cat=1157&item=7770.

"Valve—Removal and Installation" Autozone http://www.autozone.com/autozone/repairguides/Chrysler-Concorde-Intrepid-LHS-New-Yorker-Vision-1993-1997/ENGINE-MECHANICAL/Valves/_.

* cited by examiner

VEHICLE SUSPENSION SPRING SPREADER

CLAIM OF PRIORITY FROM PREVIOUSLY FILED PROVISIONAL PATENT APPLICATION

This non-provisional patent application claims the benefit of and priority from U.S. Provisional Patent Application No. 62/892,276filed Aug. 27, 2019. The inventor disclosed in, and applicant of, said provisional application is the same person as the person who is disclosed as the inventor in, and applicant of, the instant application. The applicant asserts that structures and functions of structures disclosed and described in the instant application are substantially identical to those disclosed in said provisional application.

FIELD OF THE INVENTION

This invention relates to mechanical apparatus adapted for vertically spreading an adjacent pair of turns of a vehicle's suspension spring for purposes of mounting and installation therebetween of a spring spacer.

BACKGROUND OF THE INVENTION

Mechanical apparatus for spreading and widening the vertical space between adjacent turns of a vehicle's suspension spring are known. Such apparatus are often difficult, cumbersome, and time consuming to use, particularly during the initial set up and calibration of the tool prior to commencement of spring spreading use.

The instant inventive vehicle suspension spring spreader solves or ameliorates such problems, deficits, and defects of prior art spring spreaders by providing a specially configured internally helically threaded nut which includes orbiting spreader arm engaging ends. The specialized nut of the instant invention may threadedly engage a provided rotatable jack screw, and may kinetically spin thereabout and therealong for speedy initial tool set up.

BRIEF SUMMARY OF THE INVENTION

A first structural component of the instant inventive vehicle suspension spring spreader comprises a rigid base frame. In a preferred embodiment, the rigid base frame component comprises a spacer block having a hollow bore, the base frame further comprising a pair of arm mounting plates which are fixedly bolted to opposite sides of the spacer block. In the preferred embodiment, the arm mounting plates have eyed upper and lower ends.

Upper and lower pivot arms are provided, such arms preferably having eyed proximal ends and being respectively pivotally mounted at the upper and lower ends of the base frame. In the preferred embodiment, the eyed proximal ends of the upper and lower pivot arms are respectively received between the eyed upper and lower ends of the base frame's arm mounting plates, such eyed proximal ends preferably aligning with the mounting plates' eyes for receiving upper and lower pivot pins.

A helically threaded shaft or jack screw is preferably mounted to the spacer block, such screw having a proximal end which is rotatably retained within the spacer block's hollow bore. In a preferred embodiment, the extreme proximal end of the jack screw component is configured as a hexagonal wrench engaging head which protrudes proximally from the spacer block and from the proximal end of the base frame.

The instant inventive spring spreader preferably further incorporates an internally helically threaded nut which is fitted for threaded engagement of the jack screw. Opposite orbiting ends of such nut are preferably configured as outwardly opening "C" channels which may slidably or rollably receive inner faces of the upper and lower pivot arms. Such nut is preferably kinetically spinnable about and along the jack screw for speedy movements of the nut in the proximal or distal directions, such spinning action facilitating quick pre-use set ups of the tool. In the preferred embodiment, distal ends of the upper and lower pivot arms are cupped or hooked for convenient and secure engagements with a pair of adjacent turns or flights of a vehicle's suspension spring.

In operation of the instant inventive vehicle suspension spring spreader, an operator may initially kinetically spin the internally helically threaded nut clockwise with respect to the jack screw until the nut moves to a position sufficiently close to the base frame. Such spinning of the nut preferably draws it to a proximal position which will allow, upon receipts of the pivot arms within the arms' "C" channels, sufficient inward retracting motions of the arms. Where the tool's pivot arms are sufficiently retracted, their distal ends may be inserted between the turns of a vehicle's suspension spring.

Thereafter, the operator may apply a socket wrench to the jack screw's hexagonal head, turning the screw counter clockwise. Such turning of the jack screw progressively drives the nut distally along the upper and lower pivot arms, causing the nut to function in the manner of an arm splaying wedge. The wrench driven arm splaying action of the tool advantageously forcefully engages the hooked ends of the pivot arms against the adjacent turns of the spring, effectively driving them vertically away from each other. Upon sufficient spring turn displacement, a hard rubber spacer block may be installed therebetween.

A reversal of steps described above withdraws the tool from the spring, leaving the spacer block effectively installed.

Accordingly, objects of the instant invention include the provision of a vehicle suspension spring spreader which incorporates structures as described above, and which arranges those structures in manners described above for the performance of beneficial functions described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
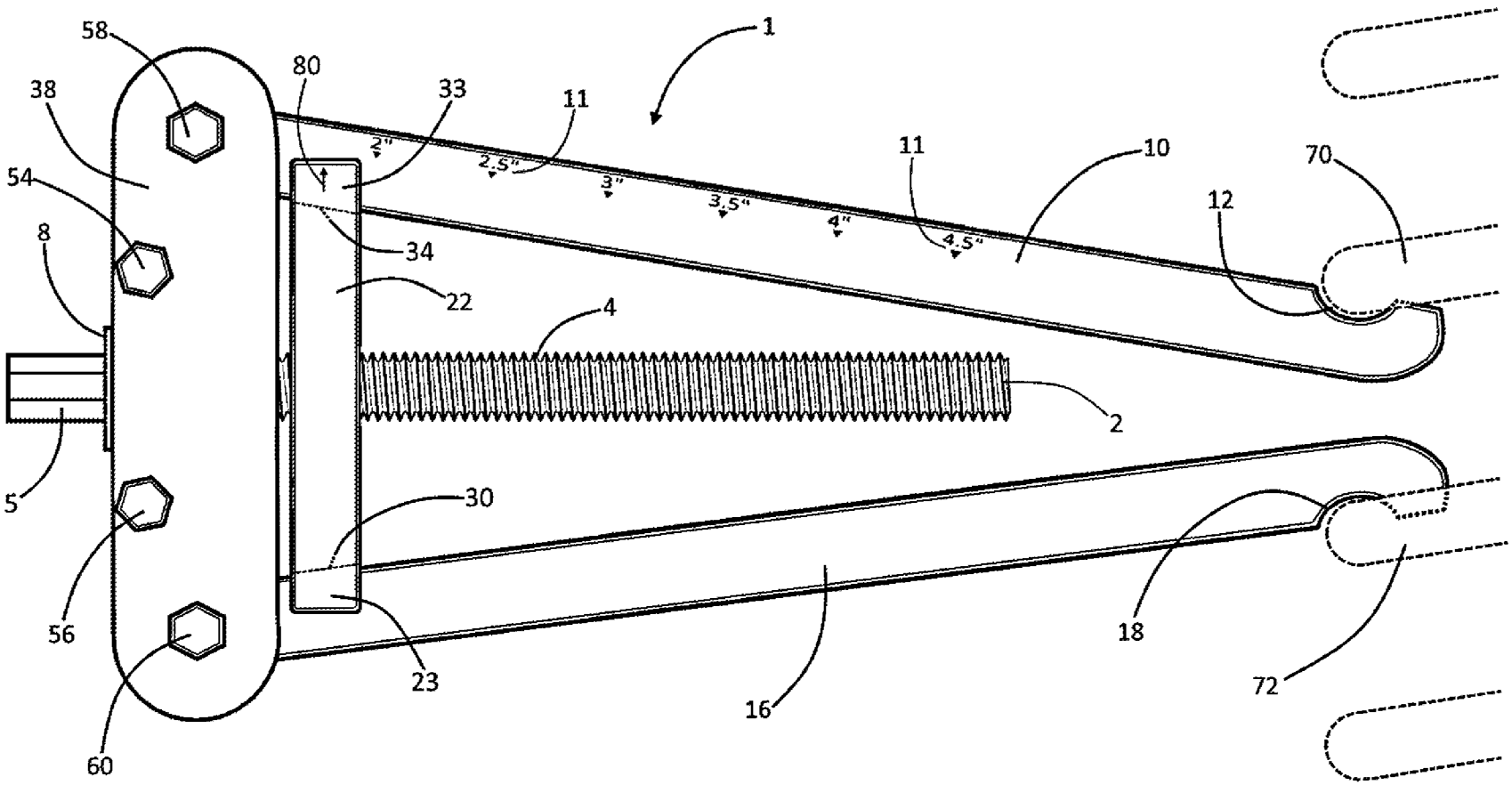
FIG. 1 is a side view of the instant inventive vehicle suspension spring spreader.
Figure 2:
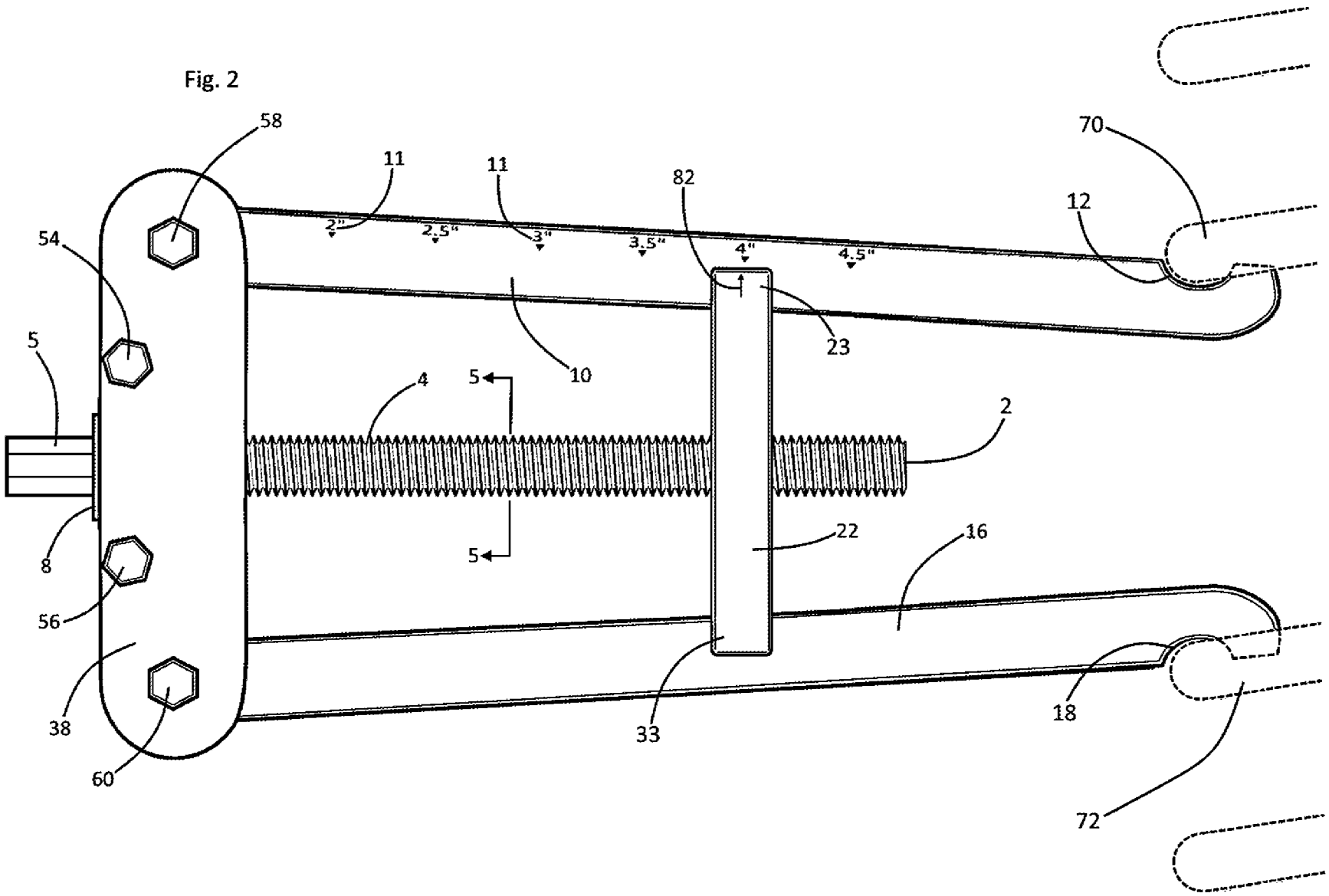
FIG. 2 redepicts the structure of FIG. 1, the view of FIG. 2 showing an alternate positioning of components.
Figure 3:
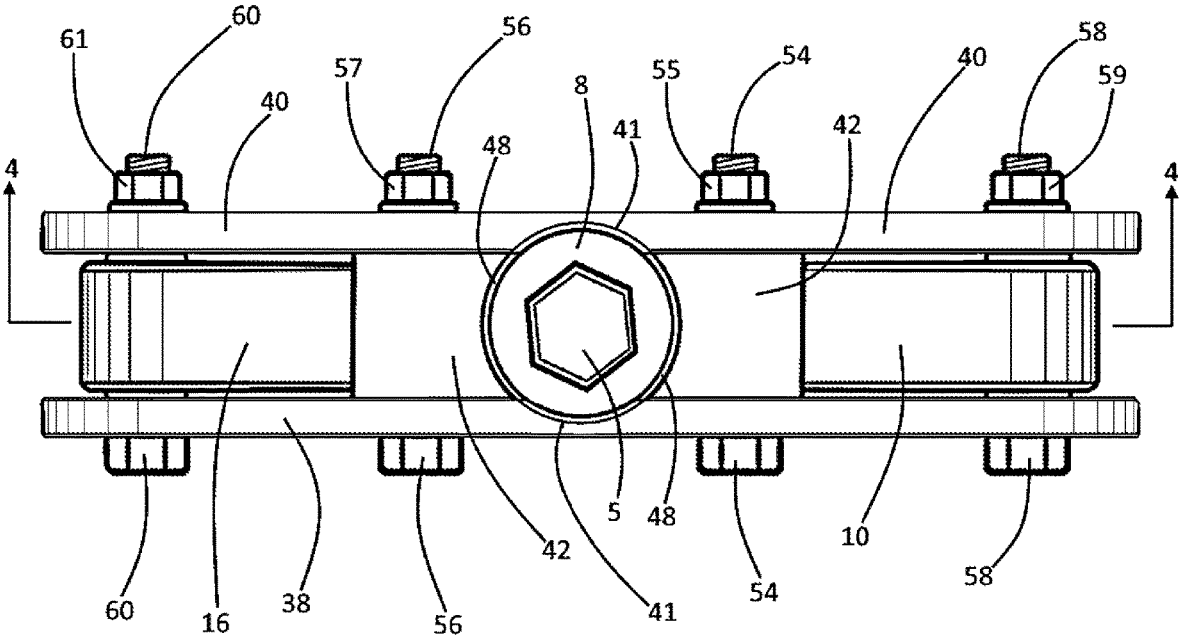
FIG. 3 is a plan view of the proximal end of the structure of FIG. 1.
Figure 4:
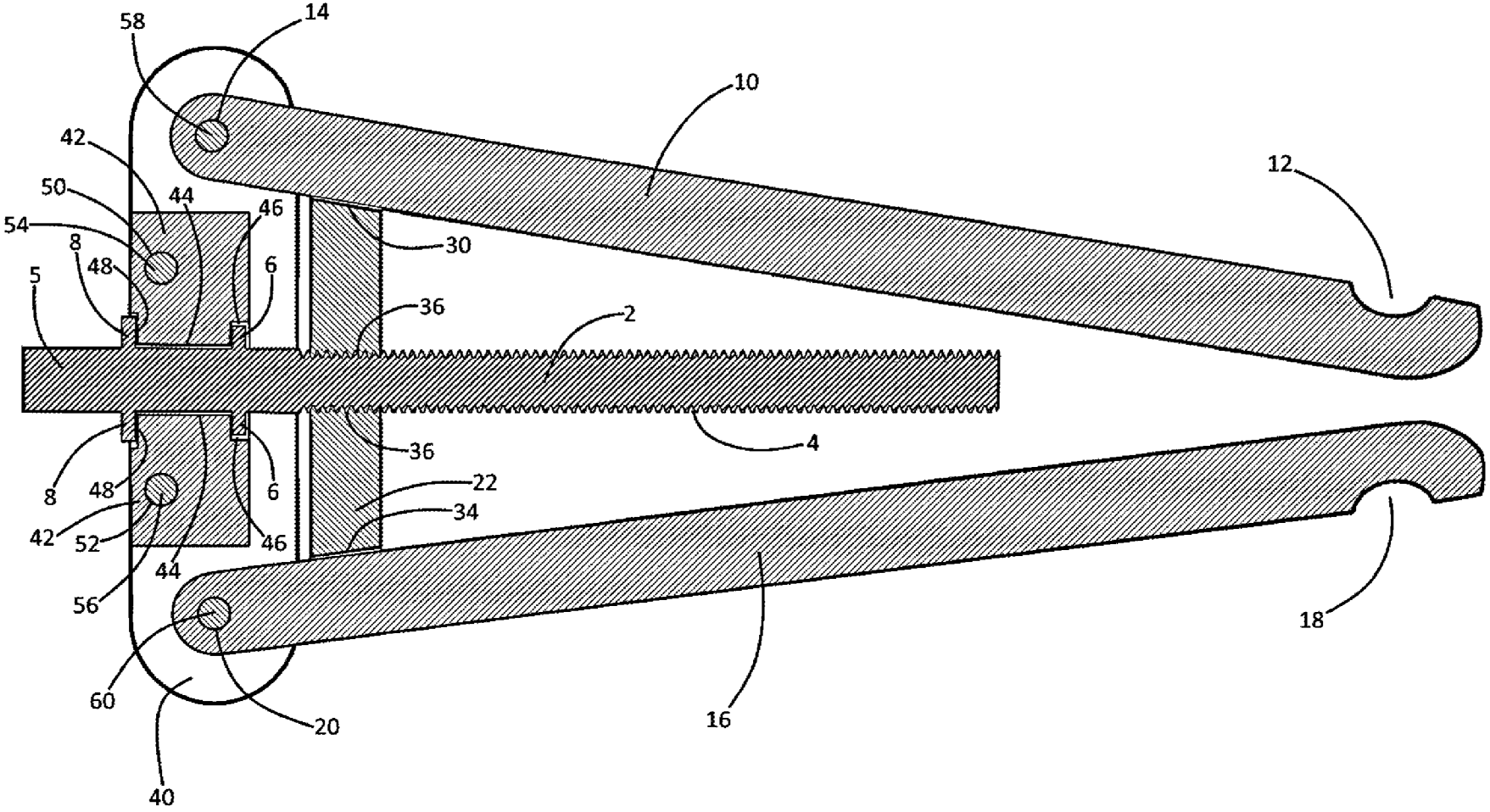
FIG. 4 is a sectional view as indicated in FIG. 3.

Referring now to the drawings and in particular simultaneously to Drawing FIGS. 1-5, a base frame component of the instant inventive spring spreader incorporates a solid steel spacer block 42 having a hollow bore 44 extending longitudinally therethrough. The distal end of the hollow bore 44 expands to form a slide stop receiving recess 46, and the proximal end of the hollow bore 44 similarly expands to form a second slide stop receiving recess 48. Bolt receiving channels 50 and 52 extend transversely through the spacer block 42.

The base frame of the instant inventive spring spreader preferably further comprises a pair of arm mounting plates 38 and 40, such plates being rigidly mounted to opposite sides of the spacer block 42 by helically threaded bolts 54 and 56, such bolts further extending through bolt receiving eyes within plates 38 and 40, and respectively through eyes 50 and 52 within the spacer block 42. Helically threaded nuts 55 and 57 are mounted over bolts 54 and 56 ascribing a rigid "I" configuration to the base frame, with plates 38 and 40 forming the feet and arms of the "I", and with spacer block 42 forming the column of the "I".

Upper and lower pivot arms 10 and 16 are preferably provided, the distal ends of such arms including concave recesses 12 and 18 adapted for hooking and engaging an adjacent pair of turns 70 and 72 of a vehicle's suspension spring. Proximal ends of the pivot arms 10 and 16 preferably include bolt receiving eyes 14 and 20 which transversely receive pivot pins 58 and 60. The arms' 14 and 20 preferably align with eyes at the upper and lower ends of the plates 38 and 40 for receipt of the pivot pins 58 and 60, such pins having helically threaded ends which are secured by helically threaded nuts 59 and 61. In a preferred embodiment, calibration notations 11 are printed or stamped upon a side wall of pivot arm 10, such calibrations 11 signifying an infinitely variable range of vertical displacements of recesses 12 and 18.

A further structural component of the instant inventive spring spreader comprises a jack screw element 2 having helical threads 4 at and along its distal end. The proximal end of the jack screw 2 preferably is smooth walled, such end extending through and is retained within bore 44 of the spacer block 42. Circular stop flanges 6 and 8 are rigidly mounted to the jack screw 2 at its proximal end, such stop flanges residing within recesses 46 and 48 for securely, fixedly, and rotatably mounting the jack screw 2 upon the spacer block 42. The extreme proximal end of the jack screw 2 preferably forms a hexagonal head 5 for engagement with a socket wrench (not depicted within views).

A further structural component of the instant inventive spring spreader comprises a nut 22 having a helically threaded longitudinally extending bore 36. In the preferred embodiment, the nut's helical threads 36 are closely fitted for threadedly engaging the helical threads 4 of the jack screw 2.

Figure 6:
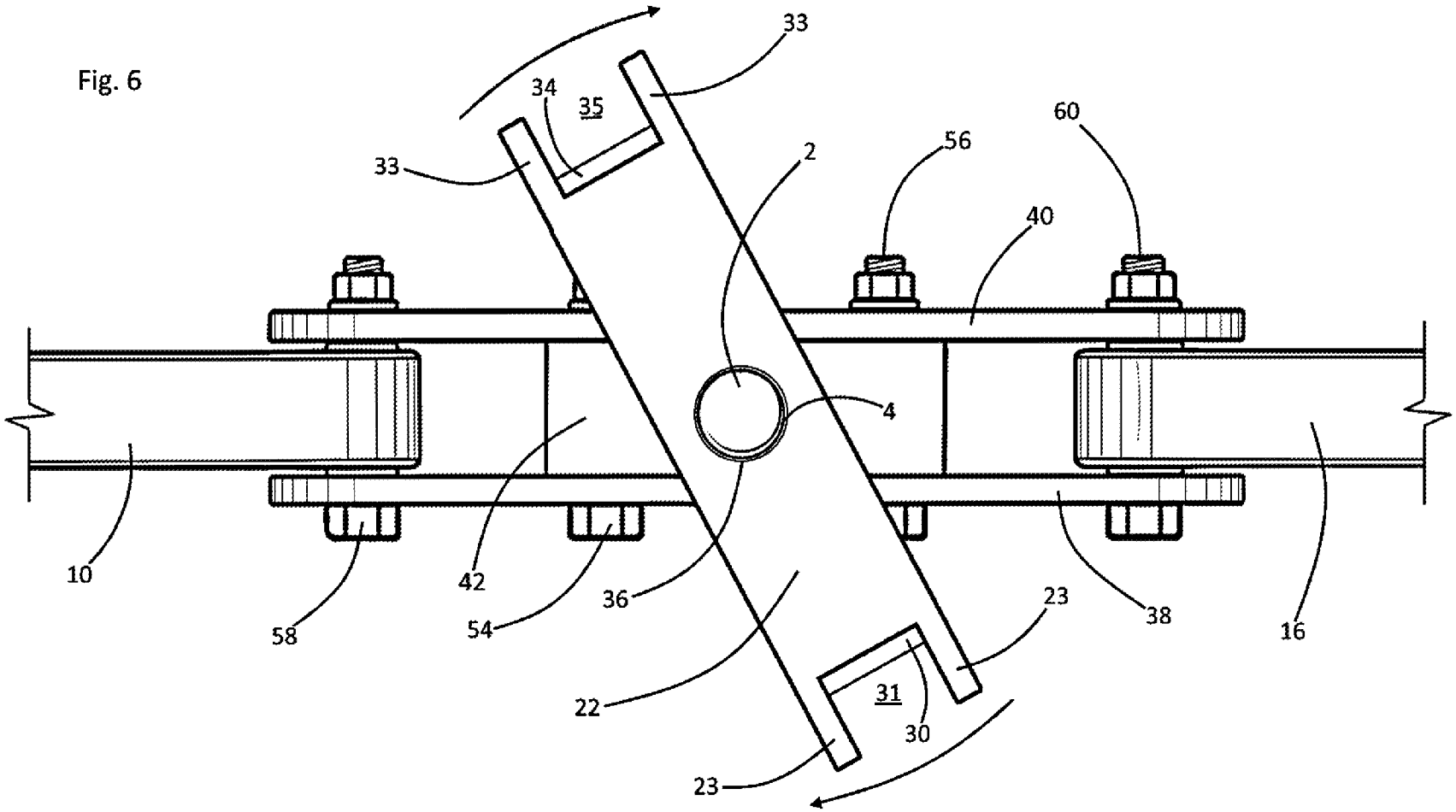
FIG. 6 is a proximal view of the FIG. 2 structure, the view of FIG. 6 alternatively showing arms splayed and showing a nut component rotated clockwise.

Referring further simultaneously to FIG. 6, opposite ends of the nut 22 form outwardly opening "C" channels 31 and 35, "C" channel 31 including a floor 30 and retainer walls 23, and "C" channel 35 including a floor 34 and retainer walls 33. In the preferred embodiment, the "C" channels' floors 30 and 34 slope inwardly from their proximal ends to their distal ends in order to facilitate a close vertical spacing of recesses 12 and 18 in the retracted configuration depicted in FIG. 1. Position indicators 80 and 82 are preferably printed or inscribed at opposite orbiting ends of the nut 22 for accurately correlating the position of the nut 22 with respect to calibrations 11.

Figure 5:
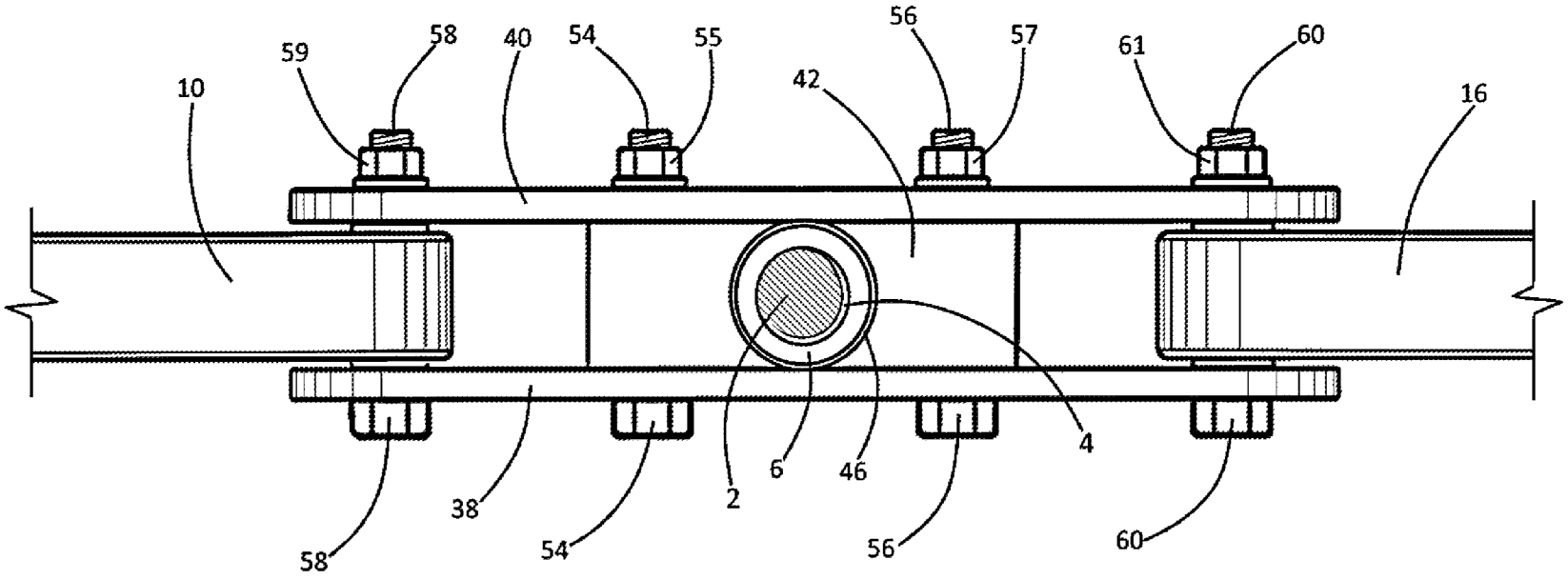
FIG. 5 is a partial sectional view as indicated in FIG. 2, the view of FIG. 5 showing arms alternatively splayed.

In use of the instant inventive vehicle suspension spring spreader, pivot arms 10 and 16 may initially be splayed upwardly and downwardly as indicated in FIGS. 5 and 6. Thereafter, an operator of the tool may grasp the base frame 38,40,42, in one hand while using his or her other hand to kinetically spin the nut 22 in a clockwise direction as indicated by arrows drawn upon FIG. 6. Such manual spinning of nut 22 causes "C" channels 31 and 35 to orbit about the jack screw 2 while causing the nut 22 to travel proximally along the jack screw 2 from a distally displaced position (such as the FIG. 2 position) to a more proximal position (such as the FIG. 1 position). The kinetic spinning of the nut 22 about and along the jack screw 2 advantageously swiftly moves the nut to a selected proximal position which is gauged to allow sufficiently inwardly retracted positions of the recesses 12 and 18. At their gauged and selected retracted positions, the distal end recesses of arms 10 and 16 may be inserted between and may engage spring turns 70 and 72. Upon manually actuated spinning and orbiting of the nut 22 to the FIG. 1 position, pivot arms 10 and 16 may freely pivot inwardly or clockwise and counter clockwise to the FIG. 1 positions with the arms' proximal nesting within "C" channels 35 and 31. The depicted angular cants of floors 34 and 30 advantageously prevents the distal ends of such floors from blocking and interfering with inward retractions of the pivot arms 10 and 16.

Thereafter, a socket wrench (not depicted within views) may be applied to the hexagonal head 5, thereby turning the head 5 and jack screw 2 counter clockwise, effectively driving the nut 22 distally away from the base frame. During such screw actuated driving of the nut 22, "C" channel floors 34 and 30 slide along inner surfaces of pivot arms 10 and 16, such sliding action progressively outwardly splaying the arms in the manner of a moveable mandrel. Roller bearings (not depicted in views) may be suitably installed at the floors 30 and 34 for minimization of sliding friction during screw actuated nut driving.

The counter clockwise turning of the hexagonal head 5 may continue until indicator 82 of nut 22 reaches, for example, the 4 inch calibration 11 upon pivot arm 10. At such calibrated position, the vertical displacements of the recesses 12 and 18 and of spring turns 70 and 72 which are carried within those recesses, correspondingly equal 4 inches. Such exemplary 4 inch displacement will allow a 3½ inch spring spacer block (not depicted within views) to be mounted between the spring's coils. Thereafter, clockwise turning of the hexagonal head 5 retracts arms 10 and 16, and allows the tool to be removed from the vehicle suspension spring.

While the principles of the invention have been made clear in the above illustrative embodiment, those skilled in the art may make modifications to the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. A tool for spreading a vehicle suspension spring, said tool comprising:

(a) a base having upper and lower ends;

(b) upper and lower arms, each such arm having a proximal end and a distal end, said arms' proximal ends being respectively pivotally attached to the base's upper and lower ends, said arms' distal ends being adapted for engaging the vehicle suspension spring;

(c) a screw mounted rotatably upon the base, the screw extending distally between the upper and lower arms; and (d) a nut threadedly mounted upon the screw, the nut having upper and lower ends, said ends being respectively adapted for engaging the upper arm and the lower arm, wherein the threaded mount of the nut upon the screw comprises a helically threaded mount.

2. The tool of claim 1 wherein the adaptations of the nut's upper and lower ends for engagements with the upper and lower arms present upwardly and downwardly opening "C" channels.

3. The tool of claim 2 wherein each "C" channel has a floor having a proximal end and a distal end, said each "C" channel floor having an inward slope from its proximal end.

4. The tool of claim 3 wherein the adaptations of the distal ends of the upper and lower arms for engagements with the vehicle suspension spring present upwardly and downwardly opening concavities.

5. The tool of claim 1 wherein the screw further extends proximally from the base, said proximal extension comprising a head adapted for engagement with a wrench.

6. The tool of claim 5 wherein the adaptation of the head for engaging a wrench comprises a hexagonal configuration.

7. The tool of claim 1 wherein the base comprises an "I" member, wherein the "I" member comprises a column, and wherein the rotatable mount of the screw upon the base mounts the screw upon the column.

8. The tool of claim 7 further comprising a longitudinally extending bore within the "I" member's column, wherein the screw's rotatable mount upon the column extends a proximal end of the screw through said bore.

9. The tool of claim 8 wherein the "I" member further comprises an upwardly extending arm, a downwardly extending arm, an upwardly extending foot, and a downwardly extending foot.

10. The tool of claim 9 wherein the pivotal attachment of the proximal end of the upper arm to the base's upper end positions such upper arm end between the "I" member's upwardly extending foot and the "I" member's upwardly extending arm, and wherein the pivotal attachment of the proximal end of the lower arm to the base's lower end positions such lower arm end between the "I" member's downwardly extending foot and the "I" member's downwardly extending arm.

11. The tool of claim 10 further comprising upper and lower pivot pins, wherein the pivotal attachments of the proximal ends of the upper and lower arms to the base's upper and lower ends transversely extend said pins through aligned eyes within said proximal ends and within the "I" member's downwardly and upwardly extending arms and feet.

12. The tool of claim 1 wherein the nut is adapted for, upon upward and downward disengagements of the upper and lower arms from the nut's upper and lower ends, and upon orbital spinning of the nut about the screw, longitudinal repositioning of the nut with respect to the upper and lower arms.

13. The tool of claim 12 further comprising a plurality of nut engagement position calibration markings, said markings being linearly arrayed along the upper arm or along the lower arm.

* * * * *